United States Patent [19]

Sterling

[11] 4,123,060

[45] Oct. 31, 1978

[54] GOLF CLUB AND JIG FOR MAKING SAME

[76] Inventor: Robert H. Sterling, 3017 Nebraska Ave., Santa Monica, Calif. 90404

[21] Appl. No.: 786,416

[22] Filed: Apr. 11, 1977

[51] Int. Cl.[2] ..... A63B 53/04

[52] U.S. Cl. ..... 273/167 R; 273/174; 144/2 XA; 269/47; 269/87.3; 269/287

[58] Field of Search ..... 273/77 R, 167–174; 144/2 G, 2 XA, 134 F, 145 B, 310 A, 321, 325; 269/47, 87.3, 287

[56] References Cited

U.S. PATENT DOCUMENTS

| | | | |
|---|---|---|---|
| 1,548,867 | 8/1925 | Burke | 273/174 |
| 1,675,437 | 7/1928 | Waldron | 144/2 XA X |
| 2,041,676 | 5/1936 | Gallagher | 273/167 A X |
| 2,100,534 | 11/1937 | Zimmerman | 269/47 X |
| 2,622,639 | 12/1952 | Meyers | 144/2 G X |
| 2,756,055 | 7/1956 | Bittner | 273/173 X |
| 2,767,749 | 10/1956 | Brandon | 144/134 R |
| 2,948,168 | 8/1960 | McCormick | 144/2 H X |
| 3,006,394 | 10/1961 | Gamboni | 144/325 |
| 3,106,111 | 10/1963 | Denisco | 269/287 X |
| 3,843,122 | 10/1974 | Florian | 273/167 R X |
| 3,908,722 | 9/1975 | Jacobs | 144/2 XA |

FOREIGN PATENT DOCUMENTS

| | | | |
|---|---|---|---|
| 136,792 | 12/1919 | United Kingdom | 273/77 R |

*Primary Examiner*—Richard J. Apley
*Attorney, Agent, or Firm*—Keith D. Beecher

[57] ABSTRACT

A golf club of the type designated a wood is provided whose head has an index tooling hole therein to which all coordinates relating to the shape of the head are referenced. During construction, the head is first placed in a tooling hole drill jig and a precisely located tooling hole is drilled in the head of a predetermined inclination and depth. A tooling jig is also provided which is constructed to hold the head during its shaping operations in a position established by a dowel pin which extends through a hole in the jig and into the aforesaid tooling hole in the head. The head is further provided with an insert plate in its front face and a sole plate in its bottom surface, the two plates being dovetailed with respect to the head and inter-locking with respect to one another so as to obviate any requirements for screws or other fastening devices. The insert and sole plate are assembled on the head so that the leading edge of the sole plate is brought under the lower edge of the insert into co-planar relationship with the face of the head so as to hold the insert in place and also to concentrate the weight of the head in an optimum position for establishing an ideal golf swing.

8 Claims, 9 Drawing Figures

GOLF CLUB AND JIG FOR MAKING SAME

BACKGROUND OF THE INVENTION

In the manufacutre of a wood head for a golf club in accordance with the teaching of the invention, a tooling hole index is used to derive all the X, Y and Z coordinates of the particular head. A numerical tape is then made up recording the coordinates, and the tape is used to drive an appropriate machine to form a master head of brass, or other suitable metal, which precisely represents the shape and size of the head. The master is placed in a copy lathe and raw wood heads corresponding in shape and size to the master are formed in the lathe. The heads of quality golf clubs are usually formed of persimmon.

In the practice of the present invention, all coordinates representing the shape of the head are referenced to the tooling hole precisely positioned in the head. These coordinates are used in the formation of the master. A plurality of raw wood heads are produced in a copy lathe from the master. A precisely located tooling hole of a predetermined depth is then drilled in each of the heads by means of a tooling hole drill jig, as will be described.

The wood heads produced by the copy lathe are completed by a series of finishing operations. Specifically, the face and bottom surface of the head are routed. A plastic insert is then mounted in the face, and a metal sole plate is mounted on the bottom surface of the club. A hozzel hole is drilled in the neck of the head to receive the shaft of the club. The face of the club is then rolled and bulged to a desired configuration with exacting tolerances, and the face and insert are then scored. The neck is then tapered; and the head is sanded, stained, sealed and lacquered in accordance with known techniques.

A second jig is provided to hold each of the raw heads for its series of secondary and/or finishing operations. The second jig is provided with a dowel pin which enters the tooling hole of the head, and with a clamp for holding the head in place. The dowel and clamp serve to position the head in the second jig to a desired orientation within exacting tolerances. The second jig is then moved from station to station, so that each of the finishing operations described above may be performed on the head, and so that these operations may conform exactly to the desired shape of the finished head.

The tooling hole may have a standard depth of, for example, 1.25 inches for all heads, and the dowel pin may have different lengths, so that different sized heads may be supported in the jig.

DETAILED DESCRIPTION OF THE ILLUSTRATED EMBODIMENT

In the practice of the present invention, the raw heads produced by the lathe, are first placed in a tooling hole drill jig 50 (FIG. 9), and a precisely located index tooling hole, of a predetermined depth is drilled in each head. The tooling hole, for example, may be parallel to the sole surface and perpendicular to the front face of the head. The tooling hole is filled with epoxy when the head is completed. It is preferably located below the center line of the head, and it can be weighted with lead or a wooden dowel if the need arises.

Figure 9:
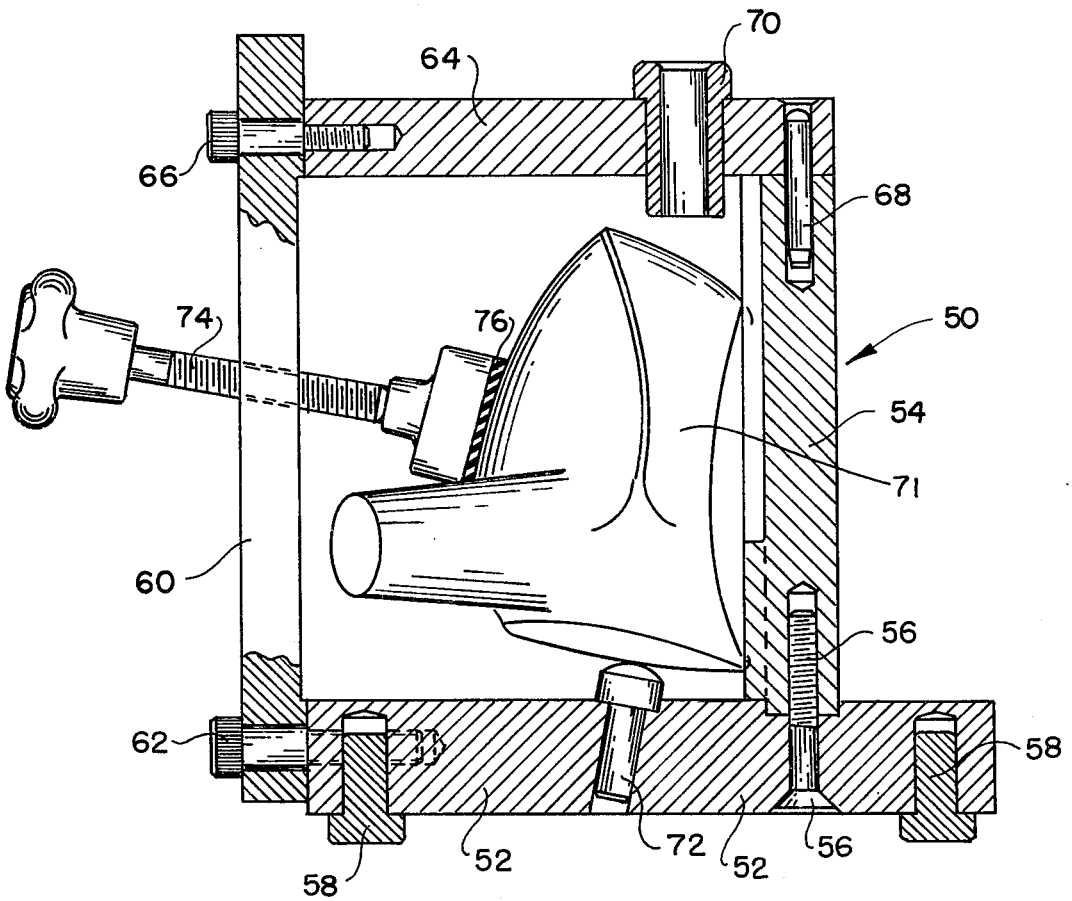
FIG. 9 is a section of a tooling hole drill jig which is also used in the construction of the head.

The tooling hole drill jig of FIG. 9 comprises a base plate 52 and an upright support plate 54 which is mounted to the base plate by a pair of screws, such as screw 56. A plurality of rest buttons, such as button 58, are mounted on the underside of base plate 52. An upright clamp plate 60 is mounted to the base 52 in spaced parallel relationship with plate 54, by means of mounting screws, such as screw 62. A bushing support plate 64 extends in spaced and parallel relationship with base 52. The plate 64 is secured to clamp plate 60 by screws, such as screw 66; and is secured to plate 54 by dowel pins, such as dowel pin 68. A drill bushing 70 is mounted in plate 64.

A raw wood head 71 from the copy lathe is mounted in the drill jig 50 with its sole surface engaging the support plate 54. The head is held in place by a locating pin 72, and by a toggle screw clamp 74 extending through plate 60. A resilient clamp pad 76 is cemented to the end of clamp 74. The index tooling hole is drilled in the head through bushing 70 which determines the direction and depth of the hole.

Figure 2:
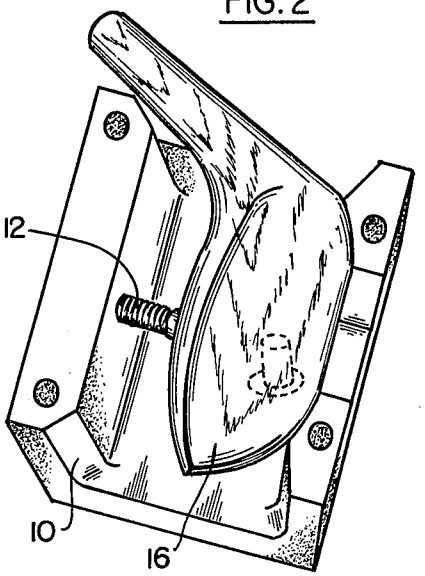
FIG. 2 is a further perspective view of the jig of FIG. 1, with the head supported in the jig.
Figure 3:
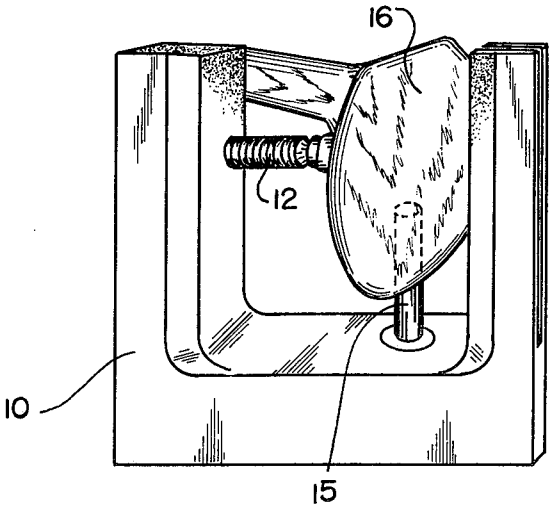
FIG. 3 is a side elevation of the jig and head of FIG. 2.
Figure 1:
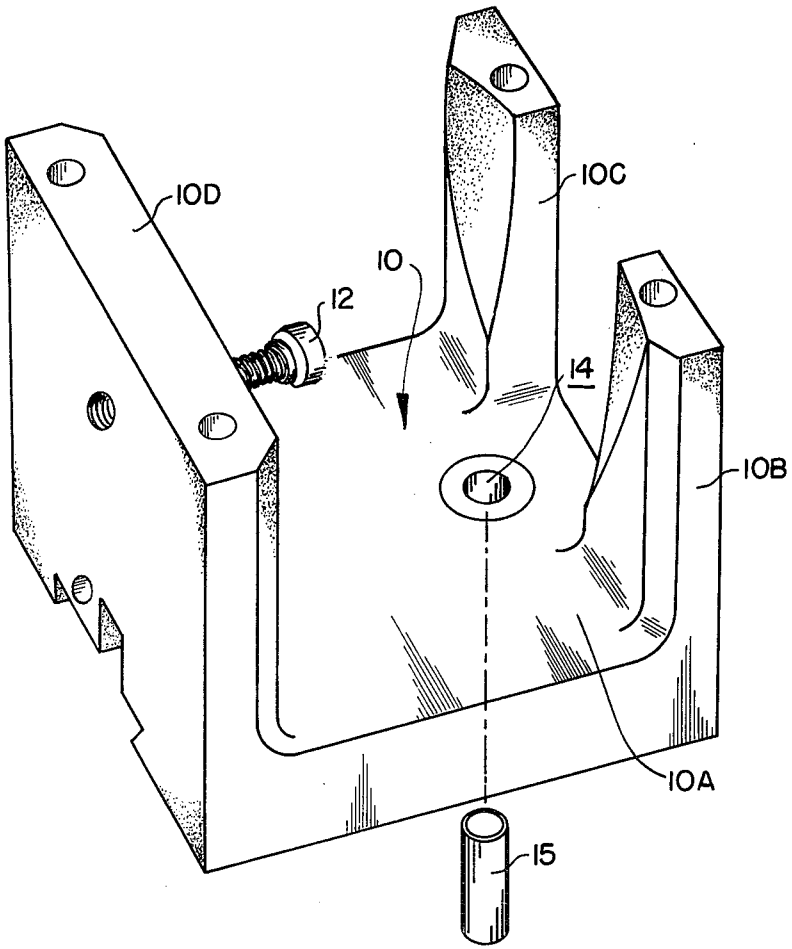
FIG. 1 is a perspective view of a tooling jig used in the construction of a wood head in accordance with the concepts of the invention, the jig being equipped with a hole for receiving a dowel pin for locating the head within the jig.

As described above, a tooling jig 10 is also provided to hold the head in a precisely predetermined position during the secondary and/or finishing operations; the tooling jig having a base 10A, and side wall 10D and two posts 10B and 10C spaced from the side wall. The jig is also provided with a clamp 12 which is threaded into the side wall 10D. The clamp serves to hold a raw golf club head 16 firmly against the posts 10B and 10C, as best shown in FIG. 2. The base 10A of the jig has a hole 14 therein which receives a dowel pin 15. The dowel pin 15 extends through hole 14 and into the index tooling hole 22 (FIG. 6) in the head. The index tooling hole, for example, may extend parallel to the sole surface of the head and perpendicular to the front face thereof.

The dowel pin 15 serves precisely to locate the head 16 in the jig 10. The dowel 15 and clamp 12 serve to position the head 16 in the jig to a desired orientation within exacting tolerances, so that the secondary and/or finishing operations described above may be performed to cause the finished head to conform exactly to a predetermined shape. Also, the hozzel hole is drilled, and then taper reamed to size to receive the exact shaft dimensions, and the neck is faced to length and tapered; the foregoing operations being performed by the use of jig 10.

Figure 7:
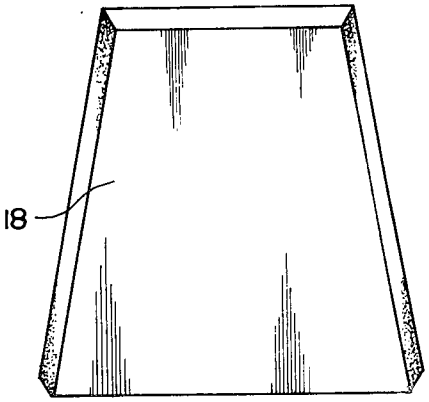
FIG. 7 is a plan view of an insert mounted in the face of the head of FIGS. 5 and 6.
Figure 8:
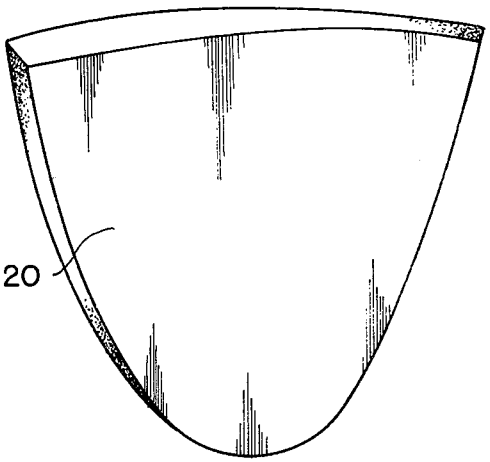
FIG. 8 is a plan view of a sole plate mounted in the bottom of the head of FIGS. 5 and 6.
Figure 5:
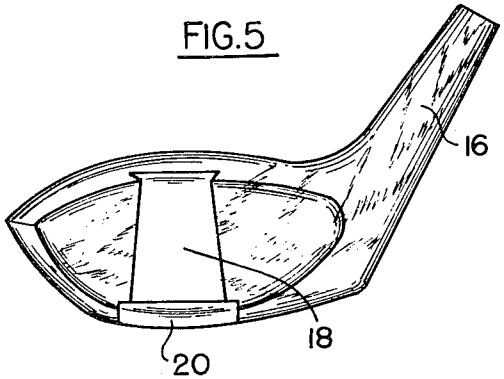
FIG. 5 is a front elevstional view of the completed head.
Figure 6:
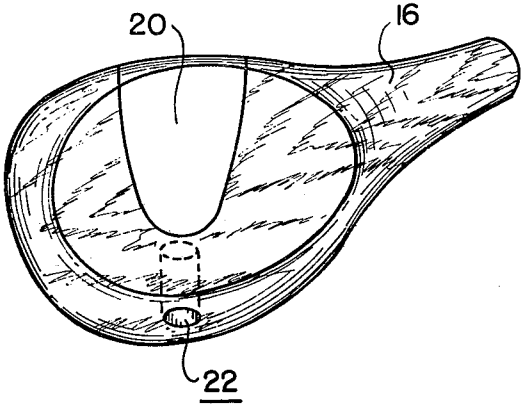
FIG. 6 is a bottom view of the head of FIG. 5.
Figure 4:
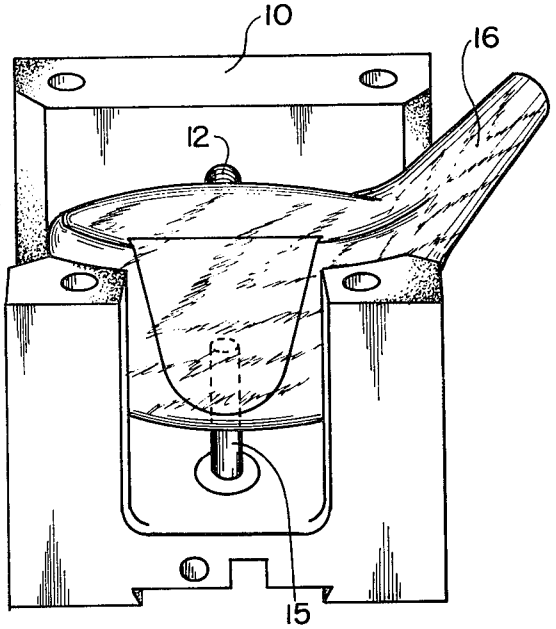
FIG. 4 is yet a further perspective view of the jig and head.

As best shown in FIGS. 5–8, the head 16 has an insert 18 mounted in its front face, and a metal sole plate 20 mounted in its bottom. The insert and sole plate are slidably fitted into respective dovetailed grooves after an epoxy has been applied. As shown in FIGS. 7 and 8, the insert and sole plate are dovetailed; and as shown in FIGS. 5 and 6, the forward edge of the sole plate extends under the bottom edge of the insert, and is flush with the front face of the head. This construction eliminates any need for screws or other features. Also, the illustrated construction, in which the leading edge of the sold plate is brought into co-planar relationship with the face of the head, serves to concentrate the weight of the head in an optimum position for establishing an ideal golf swing.

While a particular embodiment of the invention has been shown and described, modifications may be made, and it is intended in the following claims to cover all modifications which come within the true spirit and scope of the invention.

What is claimed is:

1. A head for a wood golf club having a front face, a rear portion, a sole surface, all being formed with a predetermined configuration, said head having a precisely located tooling hole therein for receiving a dowel pin so as to support the head in a predetermined precisely established position within exacting tolerances in a tooling jig during the fabrication of the head to permit finishing operations to be performed on the head so as to cause the head to conform exactly to a predetermined shape; and a jig for holding the head, said jig including a base having a hole therein precisely located at a predetermined position, a side wall extending perpendicular to the base at one side thereof, a pair of posts extending perpendicular to the base at the opposite side thereof and spaced from one another, and a clamp mounted on said side wall on the interior side thereof for holding the head firmly against the posts; and a dowel pin extending through the hole in the base to be received in the tooling hole in the head.

2. The head defined in claim 1, in which the tooling hole extends into the rear portion of the head to a predetermined depth and at right angles to the front face of the head and parallel to the sole surface thereof.

3. The head defined in claim 1, and which includes an insert mounted in the front face of the head in dovetailed relationship therewith, and a metal sole plate mounted on the sole surface of the head in dovetailed relationship therewith, the forward edge of the sole plate overlapping the bottom edge of said insert so that the forward edge of the sole plate is brought into co-planar relationship with the front face and so that said sole plate serves to retain the insert in place.

4. A method for manufacturing a head for a wood golf club having a sole surface and a front face, which method comprises: forming a precisely located index tooling hole in the head; clamping the head in a tooling jig; inserting a dowel pin through a hole in the base of the tooling jig and into the index tooling hole in the head to locate the head in the tooling jig at a desired orientation; and performing finishing operations on the head while held in the tooling jig to cause the head to conform exactly to a predetermined shape.

5. The method defined in claim 4, and which comprises forming the index tooling hole to a predetermined depth parallel to the sole surface and perpendicular to the front face of the head.

6. The method defined in claim 5, and which comprises locating the indexing tooling hole below the center line of the head.

7. The method defined in claim 4, and which comprises subsequently filling the tooling hole.

8. The method defined in claim 4, and which comprises forming dovetail grooves in the front face and sole surface of the head, and slidably fitting an insert and a sole plate respectively into the grooves on the front face and sole surface with a forward edge of the sole plate extending under the bottom edge of the insert.

* * * * *